United States Patent [19]

Sanders

[11] Patent Number: 4,908,894

[45] Date of Patent: Mar. 20, 1990

[54] ADJUSTABLE PILLOW

[75] Inventor: Janice L. Sanders, Arlington, Tex.

[73] Assignee: Ortho-Rest, Inc., Arlington, Tex.

[21] Appl. No.: 311,700

[22] Filed: Feb. 16, 1989

[51] Int. Cl.[4] ..... A47C 20/02

[52] U.S. Cl. ..... 5/436; 5/437; 5/442

[58] Field of Search ..... 5/434, 436, 437, 441, 5/442, 419

[56] References Cited

U.S. PATENT DOCUMENTS

| | | | |
|---|---|---|---|
| D. 295,936 | 5/1988 | Sanders | D6/601 |
| 1,206,775 | 11/1916 | Everts | 5/442 |
| 1,222,563 | 4/1917 | Rosenberg | 5/419 |
| 2,199,479 | 5/1940 | Cappel | 5/436 |
| 2,896,227 | 7/1959 | Reed | 5/441 |
| 3,234,569 | 2/1966 | Stewart | 5/434 |
| 3,243,828 | 4/1966 | McCarty | 5/437 |
| 3,276,046 | 10/1966 | Capelli | 5/437 |
| 3,290,704 | 12/1966 | Willis | 5/434 |
| 3,602,928 | 9/1971 | Helzer | 5/338 |
| 3,667,074 | 6/1972 | Emery | 5/337 |
| 3,698,023 | 10/1972 | Archbold | 5/436 |
| 3,775,785 | 12/1973 | Mittendorf | 5/465 |
| 4,259,757 | 4/1981 | Watson | 5/446 |
| 4,375,112 | 3/1983 | Leonhart | 5/436 |
| 4,393,530 | 7/1983 | Stark | 5/437 |
| 4,424,599 | 1/1984 | Hannouche | 5/436 |
| 4,494,261 | 1/1985 | Morrow | 5/436 |
| 4,501,034 | 2/1985 | Greenawalt | 5/434 |
| 4,513,462 | 4/1985 | Thomas | 5/442 |
| 4,550,469 | 11/1985 | Endel | 5/436 |
| 4,754,513 | 7/1988 | Rinz | 5/434 |

FOREIGN PATENT DOCUMENTS

| | | | |
|---|---|---|---|
| 8101524 | 11/1981 | Fed. Rep. of Germany | 5/436 |

*Primary Examiner*—Gary L. Smith
*Assistant Examiner*—F. Saether
*Attorney, Agent, or Firm*—Peter J. Thoma; H. Dennis Kelly

[57] ABSTRACT

An orthopedic pillow having separately adjustable neckroll and head-support sections. The neckroll section has a foam rubber pad rolled into a spiral roll and housed within a cylindrical case. The case can be opened to allow the pad to be removed and trimmed. The diameter of the neckroll can thus be adjusted to correspond to the contour of the user's neck. The head-support section has an outer section and an inner section. The thickness of the outer portion may be adjusted by adding or removing filler material. The thickness of the inner portion may be adjusted by adding or removing inlays in a stacked arrangement.

11 Claims, 2 Drawing Sheets

ADJUSTABLE PILLOW

BACKGROUND OF THE INVENTION

This invention relates generally to orthopedic support pillows. In particular, the invention relates to adjustable pillows for supporting a person's head and neck during sleep.

It is known in the art to provide pillows of varying contour to provide adequate support for a person's head and neck during sleep. For example, U.S. Pat. No. 4,494,261, issued to Morrow on Jan. 22, 1985, and U.S. Pat. No. 3,667,074, issued to Emery on June 6, 1972, disclose such pillows. Yet, a need exists for conveniently accomodating the varying head and neck contours of different individuals.

Accordingly, it is a principle object of the present invention to provide an inexpensive and readily adjustable pillow for orthopedic head and neck support.

SUMMARY OF THE INVENTION

The pillow of the invention is adjustable to the size of the user's neck and head. The pillow has a neckroll section for supporting the user's neck. The neckroll section is a pad rolled into a spiral configuration and inserted into a cylindrical case. If necessary, the pad can be removed from the case and trimmed to provide a selected diameter when returned to the case.

The pillow also has a head-support section, attached to the neckroll section, for supporting the user's head. An inner portion of the head-support section is adjacent to the neckroll section and is surrounded on the other three sides by an outer portion of the head-support section. The outer portion has an outer cover and a quantity of filler material within the cover. The thickness of the outer portion can be adjusted by adding or removing filler material.

The thickness of the inner portion of the head-support section can be adjusted by adding or removing a plurality of relatively flat inlays. A connector or closure, such as a loop and pile connector, is located on each side of each inlay and on the upper surface of the inner portion. Accordingly, a selected number of inlays can be attached to the inner portion of the head-support section, depending upon the thickness required to properly support the user's head.

Additional features and advantages of the invention will be readily understood from the following detailed description read in connection with the accompanying drawings.

DESCRIPTION OF THE PREFERRED EMBODIMENT

Figure 1A:
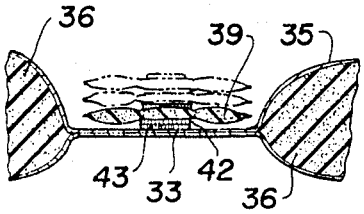
FIG. 1A is a cross-section of a portion of FIG. 1 taken along line 1A—1A of FIG. 1.
Figure 1:
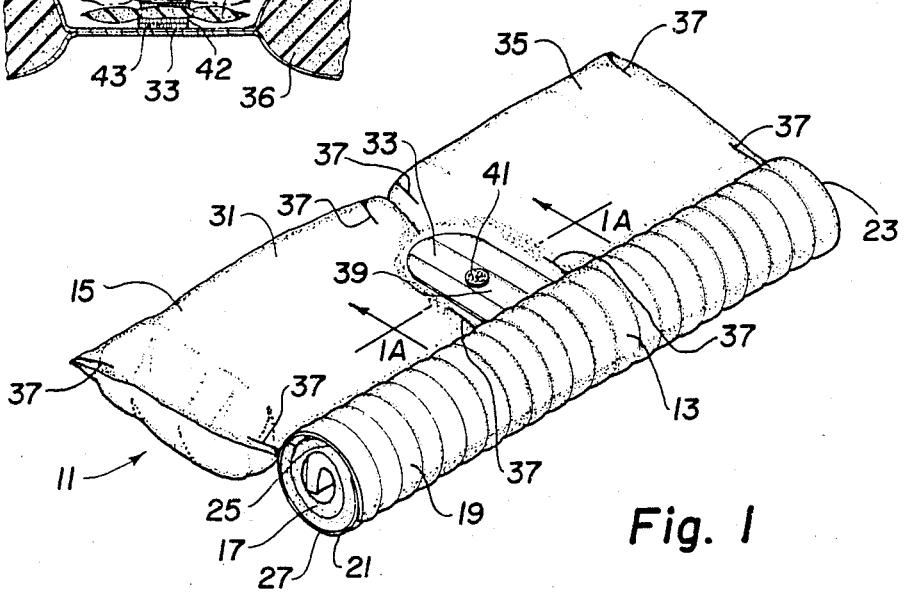
FIG. 1 is a perspective view of a preferred embodiment of a pillow in accordance with the invention.
Figure 2:
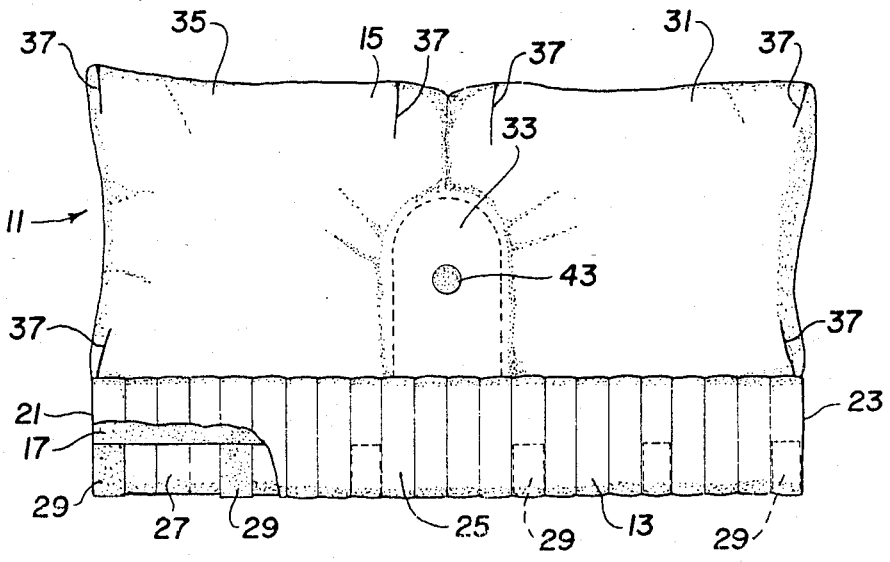
FIG. 2 is a plan view of the pillow of FIG. 1 with a portion cut away to show interior features.
Figure 3:
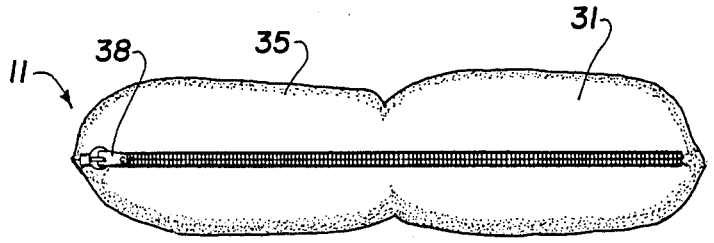
FIG. 3 is a top view of the pillow of FIG. 1.

As illustrated in FIGS. 1-3, a preferred embodiment of a pillow 11 in accordance with the present invention has two major sections, which are a neckroll section 13 and a head-support section 15. The head-support section 15 is generally rectangular, and the neckroll section 13 is sewn to one of the longer edges of the head-support section 15.

The neckroll section 13 is designed to support the user's neck, and has a foam rubber pad 17 rolled into a spiral configuration. The pad 17 is housed within a cylindrical case 19 having open ends 21 and 23. If desired for aesthetic reasons, the ends 21 and 23 of the case 19 may be closed.

The case 19 is rectangular piece of cloth sewn to the head-support section 15. The opposite edges of the cloth piece 25 are held together by a plurality of loop and pile closures 29, preferably of the type sold under the trademark VELCRO. The closures 29 can be opened to allow easy removal of the pad 17 from the case 19.

The foam rubber pad 17 is approximately the same width as the case 19, but is substantially longer in its extended condition prior to being rolled into a spiral. If a smaller neckroll 13 is desired, the pad 17 can be removed from the case 19 and trimmed to provide a selected diameter when returned to the case 19. The loop and pile closures 29 allow the two sides of the case 19 to be wrapped firmly in opposite directions around the trimmed pad 17. The case 19 can thus be adjusted to fit the diameter of the rolled pad 17.

The head-support section 15 has an outer portion 31 and an inner portion 33. The outer portion 31 of the head-support section 15 has an outer cover 35, filled with a quantity of filler material 36, seen in FIG. 1A. The thickness of the outer portion 31 can be adjusted by opening a zipper 38, shown in FIG. 3, and adding or removing filler material 36 through the opening. The filler material 36 may be any conventional material used in pillows such as polyester fiber. The outer portion 31 has numerous pleats 37 to allow the outer portion 31 to expand.

The inner portion 33 of the head-support section 15 is adjacent to the neckroll section 13 and is surrounded on the other three sides by the outer portion 31. The inner portion 33 has little or no filler material and is thus much thinner than the outer portion 31 as seen in FIG. 1A.

Figure 4:
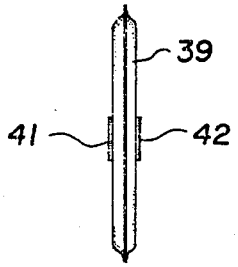
FIG. 4 is a side view of one of the inlays employed with the pillow of FIG. 1.

The thickness of the inner portion 33 can be adjusted by adding or removing a plurality of adjustment elements, such as relatively flat inlays 39. As shown in FIG. 4, each inlay 39 has complimentary parts 41 and 42 of a loop and pile connector located on each side of the inlay 39. Another loop and pile connector 43 is located in the middle of the inner portion 33 of the head-support section 15, as shown in FIG. 2.

The first inlay 39 is attached to the connector 43 in the inner portion 33 of the head-support section 15. The connectors 41 and 42 on the inlays 39 allow additional inlays 39 to be selectively added to or removed from a stack of inlays 39 on the inner portion 33.

Rather than placing the inlays 39 upon the surface of the inner portion 33, the inlays 39 could alternatively be placed within a pocket (not shown) at the inner portion. Alternatively, filler material could be placed within such a pocket. Also, the adjustment elements could be inflatable members, rather than removable inlays 39.

Adjustment of the head-support and neckroll sections 13 and 15 to accomodate individuals having different head and neck contours can readily be accomplished with the pillow 11 of the present invention. A person using the pillow 11 of the invention lies on the pillow 11 with his or her neck on the neckroll section 13 and with his or her head on the head-support section 15. The neckroll section 13 is adjusted by opening the closures 29 on the case 19, removing and trimming the pad 17, and returning the pad 17 rolled in a spiral configuration to the case 19. The closures 29 allow the case 19 to be wrapped firmly around the pad 17.

The head-support section 15 of the pillow 11 can be adjusted in two ways. The outer portion 31 of the head-support section 15 is adjusted by adding or removing filler material 36. The thickness of the inner portion 33 is adjusted by adding or removing inlays 39.

The pillow 11 of the invention has several advantages over the prior art. The thickness of the inner portion 33 of the head-support section 15 can be easily and quickly adjusted by adding or removing a selected number of inlays 39. The thickness of the outer portion 31 of the head-support section 15 can be readily adjusted in the above-described manner to provide peripheral support at the back of the head. The neckroll section 13 can be easily adjusted to maintain cervical support and minimal stress in cooperation with the separately adjustable portions of the head-support section 15. The pillow 11 of the invention thus provides optimum orthopedic support for the upper spine and head of the user.

The invention has been illustrated and described in only one of its preferred embodiments. It will be understood, however, that the invention is not so limited, but that various changes and modifications may be resorted to without departing from the spirit and scope of the invention as described by the appended claims.

What is claimed is:

1. A pillow, comprising:

an adjustable neckroll section for supporting a user's head;

a head-support section attached to the neckroll section for supporting the user's head, wherein the neckroll is substantially coextensive with the head-support section and the head-support section includes an outer portion and an inner portion, the inner portion having a connector and the inner portion being surrounded on one side by the neckroll section and on the other sides by the outer portion; and a plurality of inlays, each inlay having complementary connectors on opposite sides thereof selectively attachable to and detachable from each other and to the connector on the inner portion of the head-support section, for adjusting the thickness of the inner portion of the head-support section by adding and removing a selected number of inlays.

2. A pillow as defined in claim 1, wherein the neckroll section is generally cylindrical.

3. A pillow as defined in claim 2, wherein the neckroll section further comprises:

a pad rolled into a spiral; and a cylindrical case to house the pad.

4. A pillow as defined in claim 3, wherein the pad can be removed from the case, trimmed to provide a selected diameter when rolled, and returned to the case.

5. A pillow as defined in claim 4, wherein the case is radially adjustable.

6. A pillow as defined in claim 1, wherein the outer portion of the head-support section further comprises:

an outer cover;

means providing access to the interior of the cover;

a selected amount of filler material within the outer cover.

7. A pillow as defined in claim 1, within the complementary connectors are loop and pile connectors.

8. A pillow, comprising:

a pad rolled into a spiral of adjustable diameter providing a neck-support section;

a cylindrical case for housing the pad having members convertible to provide selected diameters to wrap snugly around the pad;

a head-support section attached to the cylindrical case for supporting the user's head and including an outer portion and an inner portion, the inner portion having one side adjacent to the cylindrical case and surrounded on its other sides by the outer portion to confine the inner portion on all sides, the outer portion having an outer cover and a quantity of filler material within the cover, wherein the head-support section is substantially coextensive with the neck-support section;

a plurality of relatively flat inlays for adjusting the thickness of the inner portion; and a plurality of complementary connectors located on opposite sides of the inlays and on the inner portion for selectively attaching or detaching inlays to the inner portion to adjust the thickness thereof.

9. A pillow defined in claim 8, wherein the complementary connectors are loop and pile connectors.

10. A pillow, comprising:

a head-support section for supporting a user's head, the headsupport section having an outer portion of a first thickness, an inner portion of a second thickness, and means for adjusting the thickness of the inner portion;

a neckroll section attached to the head-support section for supporting the user's neck, the neckroll section including an open ended cylindrical case adjustable to receive a rolled into a spiral pad of variable diameter, the cylindrical case having first and second sides extending away from the head-support section and wrapping around the pad, the sides of the case having overlapping free ends and a plurality of complementary closures at the free ends of the sides to allow the case to be opened and closed by wrapping firmly in opposite directions around the pad of variable diameter; and the head-support inner portion surrounded on one side by the neckroll section and on the other sides by the head-support outer portion.

11. A pillow as defined in claim 10, wherein the closures are loop and pile connectors.

* * * * *